US005551844A

United States Patent [19]

Fujii et al.

[11] Patent Number: 5,551,844

[45] Date of Patent: Sep. 3, 1996

[54] RECIPROCATING COMPRESSOR WITH DOUBLE HEADED PISTONS

[75] Inventors: Toshiro Fujii; Yuichi Kato; Kazuaki Iwama; Katsuya Ohyama, all of Kariya, Japan

[73] Assignee: Kabushiki Kaisha Toyoda Jidoshokki Seisakusho, Aichi, Japan

[21] Appl. No.: 498,026

[22] Filed: Jul. 3, 1995

[30] Foreign Application Priority Data

Jul. 4, 1994 [JP] Japan ..... 6-152362

[51] Int. Cl.[6] ..... F04B 49/00

[52] U.S. Cl. ..... 417/269; 417/307; 92/71

[58] Field of Search ..... 417/269, 307; 92/71; 74/66

[56] References Cited

U.S. PATENT DOCUMENTS 5,366,350 11/1994 Fujii et al. ..... 417/269
5,375,981 12/1994 Fujii et al. ..... 417/269
5,380,163 1/1995 Fujii et al. ..... 417/269

FOREIGN PATENT DOCUMENTS 57-110783 7/1982 Japan .
6-58252 3/1994 Japan .
6-101638 4/1994 Japan .

*Primary Examiner*—Charles Freay
*Attorney, Agent, or Firm*—Burgess, Ryan and Wayne

[57] ABSTRACT

A reciprocating compressor includes double headed pistons forming front and rear sets of compression chambers on either side thereof and a pair of tapered rotary valves arranged for introducing a coolant gas into the compression chambers. The valves are urged into contact with valve chambers by springs and a drive shaft is urged in one axial direction by a prestress mechanism. The valve urging force for one rotary valve is different from the valve urging force for the other rotary valve, so that the rotary valves operate at different times and over different distances and the movements of the rotary valves are controlled to move the drive shaft in the same axial direction as the direction of the prestress mechanism.

8 Claims, 7 Drawing Sheets

RECIPROCATING COMPRESSOR WITH DOUBLE HEADED PISTONS

BACKGROUND OF THE INVENTION

1. Field of the Invention

The present invention relates to a reciprocating compressor having double headed pistons with a plurality of pairs of cylinder bores formed to accept the heads of the pistons to compress a coolant gas.

2. Description of the Related Art

This type of compressor is disclosed, for example, in Japanese Unexamined Patent Publication (Kokai) No. 6-101638. In this type of compressor, as shown in FIG. 8 of the attached drawings, a drive shaft 101 is rotatably supported by a cylinder block 112, and the cylinder block 112 has a plurality of pairs of cylinder bores 102 arranged around the axis of the drive shaft 101 with each pair including coaxially extending front and rear cylinder bores 102. Double headed pistons 103 are arranged in the respective pairs of cylinder bores 102 to form compression chambers 106 with both ends of the pistons 103. The pistons 103 are reciprocatingly moved by a swash plate 104 attached to the drive shaft 101 to compress a coolant gas.

In the compressor of FIG. 8, the cylinder block 112 has valve chambers 108 arranged in the corresponding front cylinder bores 102 and rear cylinder bores 102, and rotary valves 105 are arranged in the valve chambers 108, the rotary valves 105 being supported by the drive shaft 101. Suction passages 107 are arranged in the rotary valves 105, and suction ports 111 are arranged in the cylinder block 112 adjacent to the cylinder bores 102, for introducing a coolant gas from the suction chamber (crank chamber) into the compression chambers 106 during suction strokes.

In this compressor, it is not necessary to arrange suction valves for every compression chamber 106, and the structure of the compressor can be simplified. However, in this compressor, wear may occur in the sliding inner and outer surfaces of the valve chambers 108 and the rotary valves 105, so that the sealing function declines.

Such a sealing problem may be solved by a compressor disclosed, for example, in Japanese Unexamined Patent Publication (Kokai) No. 6-58252. In this type of compressor, as shown in FIG. 9 of the attached drawings, rotary valves 105 and valve chambers 108 are formed in a tapered shape, and springs 109 are provided for urging the rotary valves 105 into contact with the valve chambers 108. When wear occurs on the sliding inner and outer surfaces of the valve chambers 108 and the rotary valves 105, the rotary valves 105 advance further into the valve chambers 108 to absorb the wear, and the sealing function is maintained.

In addition, the outer surfaces of the rotary valves 105 in the compressor of FIG. 9 are tapered, and a higher pressure acts obliquely on the outer surfaces of the rotary valves 105 via the suction ports 111 if the pressure in the compression chambers 108 rises abnormally due to a liquid compression, for example. The high pressure acting on the rotary valves 105 includes a component of a force in the axial direction of the rotary valves 105. Therefore, the rotary valves 105 are moved in the direction of the arrow against the springs 109 to produce a clearance between the rotary valves 105 and the valve chambers 108, with the result that the pressure in the compression chambers 108 is released via the suction ports 111 into the compression chambers 108. On the other hand, the pistons 103 are subjected to a compression reaction force by the pressure in the compression chambers 108, and the drive shaft 101 also receives the compression reaction force via the pistons 103 and the swash plate 104. However, since the higher pressure is released, an excessive compression reaction force acting on the drive shaft 101 is mitigated.

In addition, a prestressed spring (not shown) is provided in the compressor for urging the drive shaft 101 in an axially predetermined direction to prevent the drive shaft 101 from undesirably oscillating. However, the degree and the timing of the released pressure from the front compression chambers 108 may be different from those from the rear compression chambers 108 because it is not usual that an amount of liquid coolant remaining in the front compression chambers (causing a liquid compression) is identical to an amount of liquid coolant remaining in the rear compression chambers. Therefore, there is a possibility that the compression reaction force acts on the drive shaft 101 in the direction in reverse to the direction of the urging force by the spring. The drive shaft may thus undesirably oscillate, so noise in the compressor may increase.

SUMMARY OF THE INVENTION

The object of the present invention is to solve the above described problems and to provide a reciprocating compressor having double headed pistons in which a drive shaft can be prevented from undesirably oscillating when the pressure in the compression chambers rises abnormally due to liquid compression and the like, noise in the compressor can be reduced.

According to the present invention, there is provided a reciprocating compressor comprising a housing having an axis, a plurality of pairs of cylinder bores arranged around the axis with each pair including coaxially extending front and rear cylinder bores, a crank chamber formed between front and rear cylinder bores, and tapered valve chambers formed in the cylinder block on either side of the crank chamber along the axis, the tapered valve chambers having conical inner surfaces. Double headed pistons are arranged in the respective pairs of cylinder bores to form compression chambers at either end of the pistons. A drive shaft is inserted in the crank chamber and the valve chambers are rotatably supported by the housing, and a cam plate arranged in the crank chamber and fixed to the drive shaft to engage with the pistons for reciprocatingly moving the pistons. A pair of tapered rotary valves are arranged in the valve chambers and supported by the drive shaft so that each rotary valve can rotate with the drive shaft and can move axially relative to the drive shaft, the rotary valves having conical outer surfaces to make surface-contact with the conical inner surfaces of the valve chambers, the rotary valves having suction passages for introducing a coolant gas into the compression chambers during suction strokes. A first urging means urges each of the rotary valves into contact with the conical inner surface of the associated valve chamber, and a second urging means urges the drive shaft in an axially predetermined direction. The compressor, is characterized by means for controlling movements of the rotary valves away from the valve chambers caused by a pressure in the compression chambers when the pressure in the compression chambers becomes higher than the compression pressure during a normal operation of the compressor so that a compression reaction force acting on the drive shaft via the pistons and the cam plate occurs in said axially predetermined direction.

In this arrangement, when the pressure in the compression chambers rises abnormally due to liquid compression or the like, the pressure in the compression chambers acts on the outer surface of the rotary valves and tends to move the rotary valves away from the inner surfaces of the valve chambers against the first urging means. The pressure in the compression chambers is thus released. In this case, one rotary valve is moved an amount smaller than and/or at a timing later than the other rotary valve, so that the compression reaction force acting on the drive shaft occurs in the same direction as of the second urging means.

Preferably, the crank chamber is formed to function as a suction chamber which is connected to a suction side an outside refrigerating circuit, and the valve chambers are arranged so that the larger diameter sides of the valve chambers face the crank chamber. In this arrangement, the rotary valves are moved toward the crank chamber, and the pressure in the compression chambers is released into the crank chamber, i.e., the suction chamber.

Preferably, the means for controlling movements of the rotary valves is arranged such that the amount of the movement of one rotary valve is smaller than the amount of the movement of the other rotary valve. In this arrangement, the force which acts on the drive shaft in the urging direction of the second urging means depends on the difference between the amounts of the movements of two rotary valves.

Preferably, the means for controlling the movements of the rotary valves is arranged such that the timing of the movement of one rotary valve is later than the timing of the movement of the other rotary valve. In this arrangement, the compression reaction force acts on the drive shaft in the urging direction of the second urging means depending on the difference between the timings of the movements of two rotary valves.

Preferably, the means for controlling the movements of the rotary valves is arranged such that the urging force of said first urging means for one rotary valve is greater than the urging force of said first urging means for the other rotary valve. In this arrangement, it is possible to control the direction of the compression reaction force acting on the drive shaft only by changing the urging force of the first urging means.

Preferably, the means for controlling the movements of the rotary valves includes means for regulating the movements of the rotary valves such that the amount of the movement of one rotary valve is smaller than the amount of the movement of the other rotary valve. In this arrangement, it is possible to control the direction of the compression reaction force acting on the drive shaft by providing a regulating means having a simple structure such as a projection.

Preferably, the housing has suction ports, and the means for controlling movements of the rotary valves is arranged such that an opening of the suction port for one rotary valve is smaller than the opening of the suction port for the other rotary valve. In this arrangement, it is possible to controls the direction of the compression reaction force acting on the drive shaft only by changing the opening area of the suction port.

Preferably, the means for controlling movements of the rotary valves is arranged such that the angle of the taper of one rotary valve is smaller than the angle of the taper of the other rotary valve. In this arrangement, it is possible to control the direction of the compression reaction force acting on the drive shaft by only changing the angle of the taper of the rotary valve.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
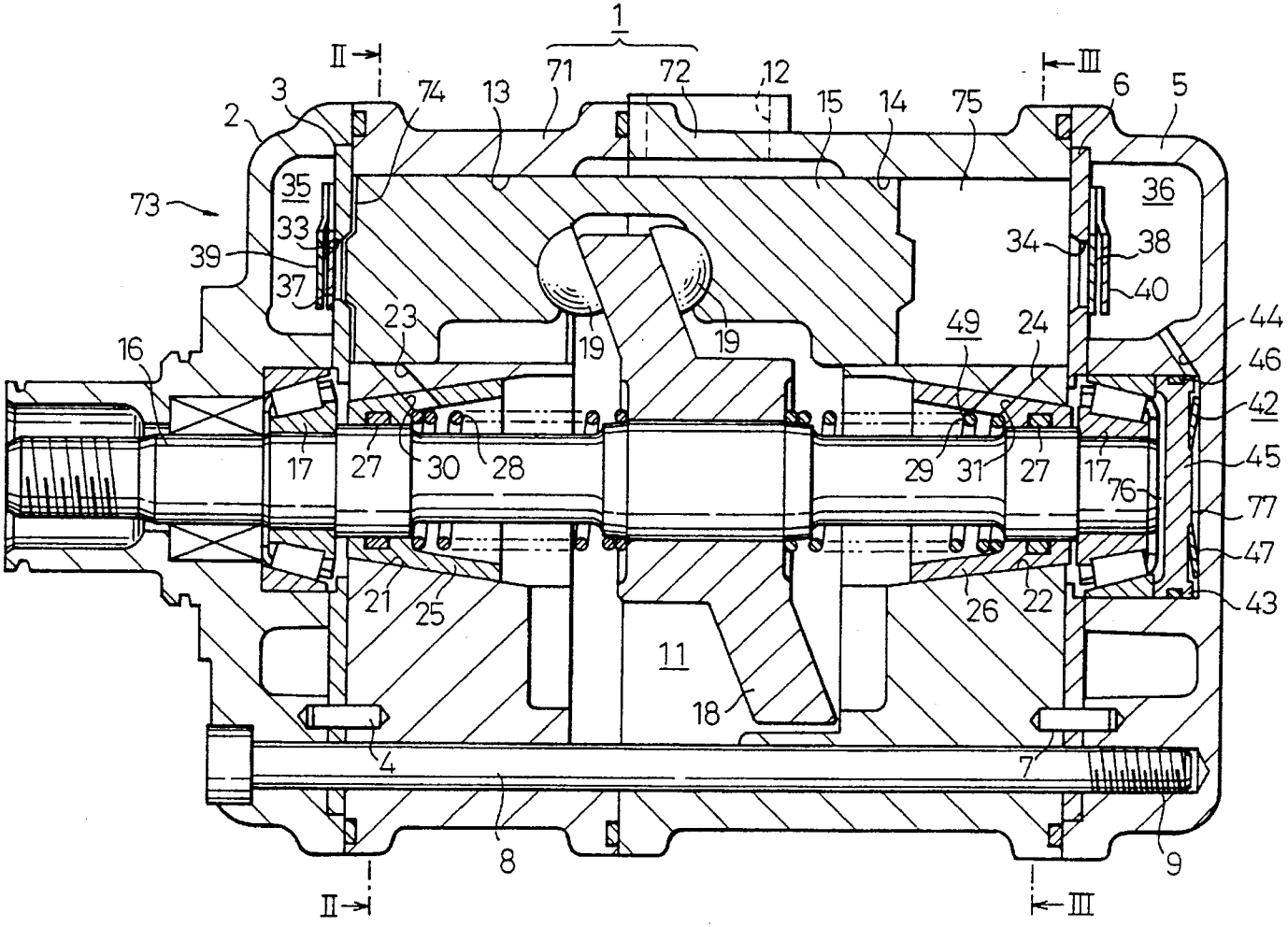
FIG. 1 is a cross-sectional view of a swash plate type compressor having double headed pistons according to the first embodiment of the present invention.
Figure 2:
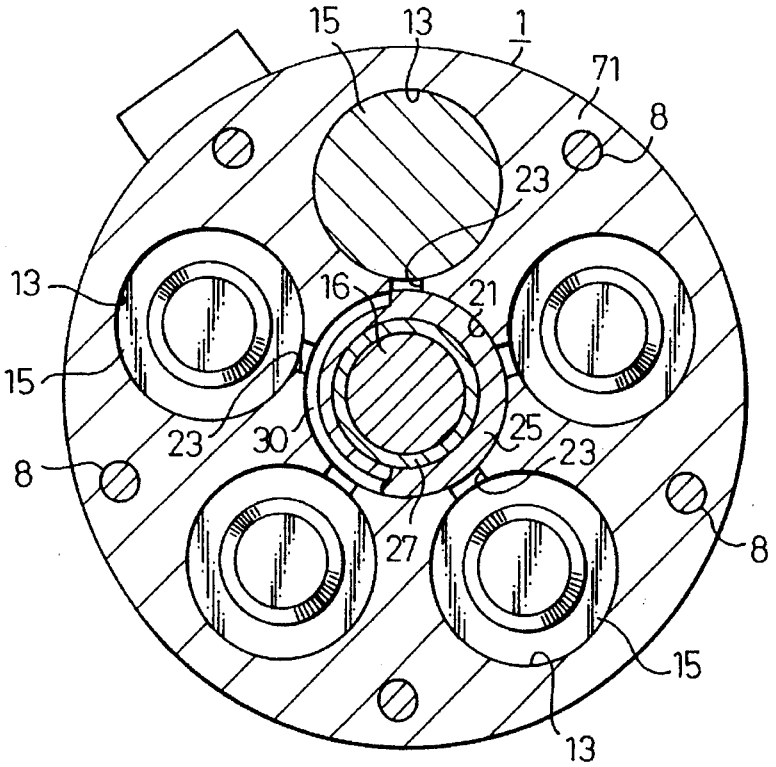
FIG. 2 is a cross-sectional view, at a reduced scale, of the compressor of FIG. 1, taken along the line II—II in FIG. 1.
Figure 3:
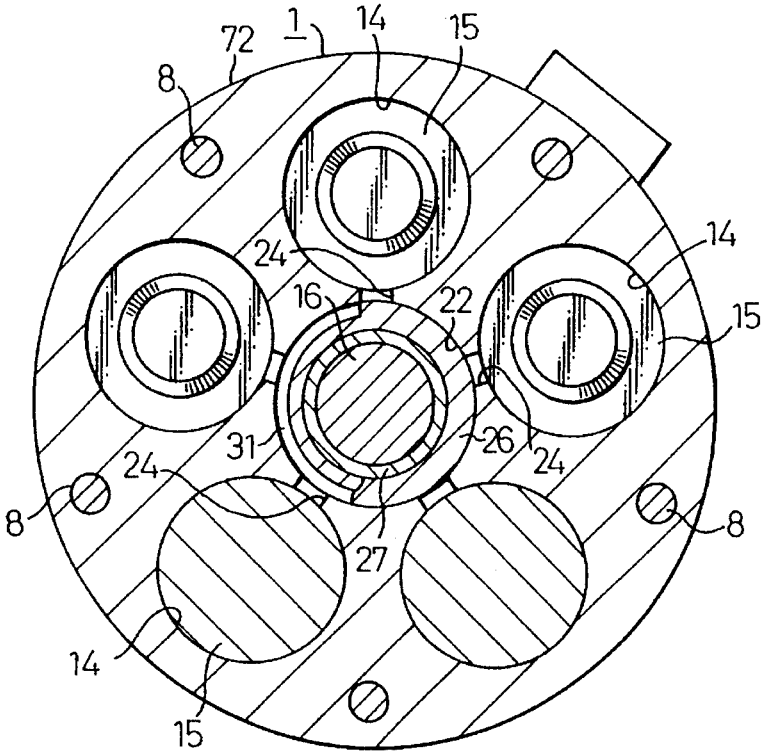
FIG. 3 is a cross-sectional view, at a reduced scale, of the compressor of FIG. 1, taken along the line III—III in FIG. 1.

FIGS. 1 to 3 show a swash plate type compressor having double headed pistons according to the first embodiment of the present invention.

In FIG. 1, a cylinder block 1 is formed by front and rear block members 71 and 72 coupled together. A front housing member 2 is attached to the front surface of the cylinder block 1 via a valve plate 3 and arranged in position relative to the cylinder block 1 and the valve plate 3 by a pin 4. A rear housing member 5 is attached to the rear surface of the cylinder block 1 via a valve plate 6 and arranged in position relative to the cylinder block 1 and the valve plate 6 by a pin 7. A plurality of bolts 8 extend from the front surface of the front housing member 2 through the cylinder block 1 to the rear housing member 5 and are engaged in threaded holes 9 in the rear housing member 5 to fasten the front housing member 2, the valve plate 3, the cylinder block 1, the valve plate 6, and the rear housing member 5 together. The cylinder block 1, the front housing member 2 and the rear housing member 5 together form the housing of the compressor.

A drive shaft 16 is rotatably supported by a pair of roller bearings 17 in the front and the rear housing members 2 and 5 so that the drive shaft 16 extends along the central axis of the cylinder block 1.

A plurality of pairs of cylinder bores 13 and 14 are arranged in the cylinder block 1 around the central axis of the drive shaft 16 at a circumferentially constant pitch with each pair including coaxially extending front and rear cylinder bores 13 and 14. Double headed pistons 15 are arranged in the respective pairs of cylinder bores 13 and 14 to form compression chambers 74 and 75 on either side of pistons 15.

As shown in FIGS. 1 to 3, a crank chamber 11 is formed centrally in the cylinder block between the front cylinder bores 13 and the rear cylinder bores 14. The crank chamber 11 is formed to function as a suction chamber which is connected to a suction side of an outer refrigerating circuit via an inlet port 12. A cam plate or a swash plate 18 is arranged in the crank chamber 11 and is fixed to the drive shaft 16 to engage with the intermediate portions of the pistons 15. Therefore, the double headed pistons 15 are reciprocatingly moved by the swash plate 18 when the drive shaft 16 rotates.

Front and rear tapered valve chambers 21 and 22 are formed in the cylinder block 1 on either side of the crank chamber 11 along the central axis of the drive shaft 16. The valve chambers 21 and 22 have conical inner surfaces and the larger diameter sides of the valve chambers 21 and 22 face the crank chamber 11. A plurality of suction ports 23 and 24 are formed in the cylinder block 1 at positions between the valve chambers 21 and 22 and the cylinder bores 13 and 14 for communication of each of the compression chambers 74 and 75 in the cylinder bores 13 and 14 at either end of the pistons 15 with each of the valve chambers 21 and 22.

A pair of tapered rotary valves 25 and 26 are arranged in the valve chambers 21 and 22 and are supported by the drive shaft 16 via sealing rings 27 so that each rotary valve 25 or 26 can rotate with the drive shaft 16 and can move axially relative to the drive shaft 16. The rotary valves 25 and 26 have conical outer surfaces to make surface-contact with the conical inner surfaces of the valve chambers 21 and 22. A pair of springs 28 and 29 acting as first urging means are arranged between the respective rotary valves 25 and 26 and the swash plate 18 for urging the rotary valves 25 and 26 toward the smaller diameter sides of the valve chambers 21 and 22 into contact with the conical inner surfaces of the valve chambers 21 and 22. Suction passages 30 and 31 are formed though the circumferential walls of the rotary valves 25 and 26 at positions corresponding to the suction ports 23 and 24.

The suction passages 30 and 31 are formed in the following shape. With the rotation of the rotary valves 25 and 26, the suction passages 30 and 31 are connected to the suction ports 23 and 24 during suction strokes in which the pistons 15 move from the respective top dead center positions to the bottom dead center positions. Therefore, a coolant gas is introduced from the crank chamber 11 into the compression chambers 74 and 75 through the suction passages 30 and 31 and the suction ports 23 and 24. On the other hand, the coolant gas is not introduced from the crank chamber 11 into the compression chambers 74 and 75 during compression strokes in which the pistons 15 move from the respective bottom dead center positions to the top dead center positions.

A plurality of discharge ports 33 and 34 are formed in the valve plates 3 and 6 corresponding to the compression chambers 74 and 75, as shown in FIG. 1. A discharge chamber 35 is formed in the front housing member 2 and a discharge chamber 36 is formed in the rear housing member 5. The discharge chambers 35 and 36 are connected to the compression chambers 74 and 75 via the discharge ports 33 and 34, respectively. The discharge chambers 35 and 36 are connected to a discharge outlet (not shown) which is connected to outside coolant gas piping.

Discharge valves 37 and 38 are arranged on the valve plates 3 and 6 at the outer ends of the discharge ports 33 and 34, respectively, and retainers 39 and 40 restrict the opening of the discharge valves 37 and 38. When the pistons 15 move from the respective bottom dead center positions to the top dead center positions, the coolant gas is compressed in the compression chambers 74 and 75 in the cylinder bores 13 and 14 and discharged into the discharge chambers 35 and 36 through the discharge ports 33 and 34 by opening the discharge valves 37 and 38.

A prestress mechanism 42 acting as a second urging means is arranged at a position corresponding to the rear end of the drive shaft 16 for urging the drive shaft 16 in an axially predetermined direction. In the embodiment, the prestress mechanism 42 axially forwardly urges the drive shaft 16. To this end, the rear housing member 5 has a prestress chamber 43 at the center of the rear housing member 5, and the rear end portion of the prestress chamber 43 is connected to the discharge chamber 36 via a port 44. A thrust plate 45 is arranged in the prestress chamber 43 so as to engage with the fixed outer ring of the roller bearing 17, and a seal ring 46 is arranged on the outer surface of the thrust plate 45. The thrust plate 45 can reciprocatingly move along the axis of the drive shaft 16. The thrust plate 45 divides the interior of the prestress chamber 43 into an front space 76 and a rear space 77.

Therefore, when the compressor is driven, the pressure of the coolant gas in the crank chamber 11 is introduced into the front space 76 via a clearance between the valve chamber 22 and the rotary valve 26 and a clearance in the roller bearing 17, and the pressure of the coolant gas in the discharge chamber 36 is introduced into the rear space 77 via the port 44. Accordingly, a pressure difference occurs between the front side and the rear side of the thrust plate 45 depending on a refrigerating load, and the drive shaft 16 is forwardly urged by the pressure via the roller bearing 17.

A belleville spring 47 is also arranged in the prestress chamber 43 between the thrust plate 45 and the rear end wall of the prestress chamber 43 so as to forwardly urge the thrust plate 45. Therefore, the drive shaft 16 is also forwardly urged by the spring 47 to some extent, even if a pressure difference does not exist between the front side and the rear side of the thrust plate 45 when, for example, the compressor starts to operate.

A control mechanism 49 acting as movement control means is arranged in association with the rotary valves 25 and 26 for controlling the amount and/or the timing of the movement of the rotary valves 25 and 26 away from the valve chambers 21 and 22. In the embodiment, the spring 29 for one of the rotary valves 26 located near the prestress mechanism 42, has a greater spring constant than that of the spring 28 for the other rotary valve 25 located far from the prestress mechanism 42. Therefore, the urging force of the rear spring 29 is greater than that of the front spring 28. However, the distance between the inner surface of the front rotary valve 25 and the swash plate 18 is identical to the distance between the inner surface of the rear rotary valve 26 and the swash plate 18, and the springs 28 and 29 have identical initial lengths.

Alternatively, it is possible to prepare two springs having identical spring constants and different initial lengths, in place of the springs 28 and 29, wherein the shorter spring is used for the front rotary valve 25 and the longer spring is used for the rear rotary valve 26 and the longer spring is more compressed in use than the shorter spring. In this case too, the urging force of the rear spring is greater than that of the front spring.

The operation of the double headed swash type compressor is described. The pistons 15 are reciprocatingly moved to repeat the suction and compression strokes. A cooling gas is thus introduced from the crank chamber 11 through the valve chambers 21 and 22, the suction passages 30 and 31, and the suction ports 23 and 24, into the compression chambers 74 and 75. The compressed coolant gas is discharged from the compression chambers 74 and 75 through the discharge ports 33 and 34 into the discharge chambers 35 and 36.

If a liquid coolant exists and is compressed in the compression chambers 74 and 75, the pressures in the compression chambers 74 and 75 abnormally rise. When the pressures becomes higher than the compression pressures in the compression chambers 74 and 75 during normal operation of the compressor, the rotary valves 25 and 26 are caused to rearwardly move away from the valve chambers 21 and 22 toward the crank chamber 11 against the springs 28 and 29. Thereby, the suction ports 23 and 24 are opened into the valve chambers 21 and 22, and the pressures in the compression chambers 74 and 75 are released to the crank chamber 11 via the suction ports 23 and 24 and the suction passages 23 and 24, with the result that an overload of the compressor is prevented.

In this situation, the rear rotary valve 26 is rearwardly moved at a timing later than and with a distance smaller than those of the front rotary valve 26, since the urging force of the rear spring 29 is greater than that of the front spring 28. Therefore, among all the compression chambers 74 and 75, the liquid compressing state in the front compression chambers 74 is cancelled earlier than that of the rear compression chambers 75. In other word, the liquid compressing state in the rear compression chambers 75 is prolonged more than that of the front compression chambers 74. Therefore, a compression reaction force acting on the drive shaft 16 via the pistons 15 and the cam plate 18 occurs in the same direction as the urging direction of the prestress mechanism 42.

Therefore, the prestress is not counterbalanced by the compression reaction force but is rather multiplied by the compression reaction force, whereby a possibility that the drive shaft 16 may be undesirably moved in the axial direction and may undesirably oscillate is prevented. Therefore, it is possible to reduce the vibration and the noise of the compressor during the operation thereof and to increase the life of the roller bearings 17. In addition, the present invention can be attained, in a simple arrangement, by only changing the urging forces of the springs 28 and 29, without providing additional elements.

Further embodiments of the swash plate type compressor according to the present invention are described with reference to FIGS. 4 to 7. In each of these embodiments, the feature of the control mechanism 49 acting as a control means is changed from that of the first embodiment.

Figure 4:
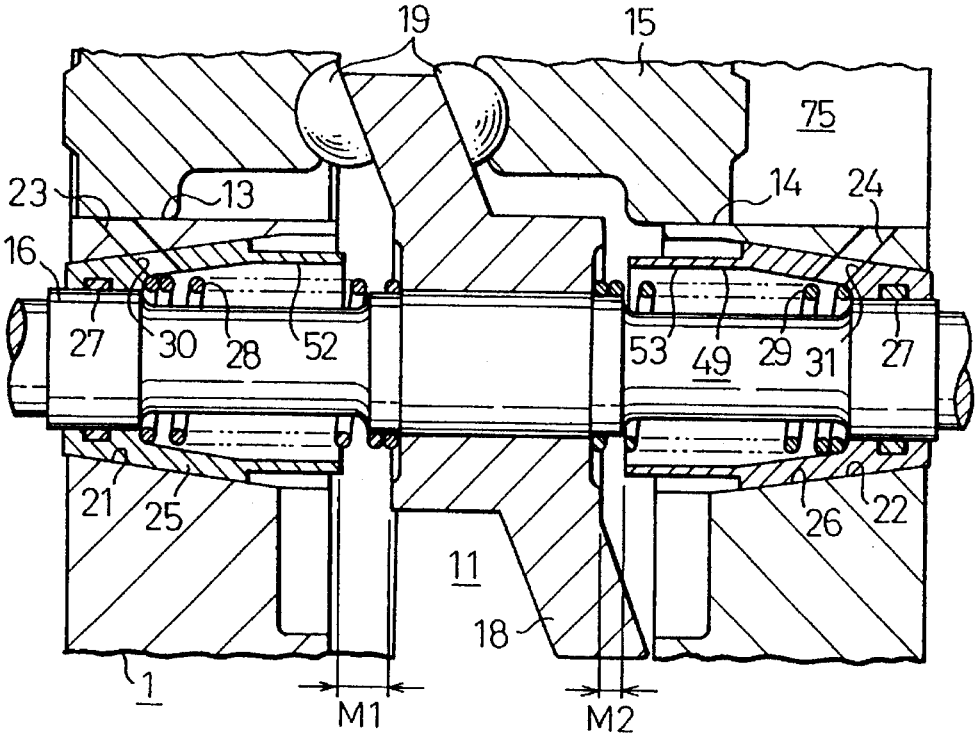
FIG. 4 is a cross-sectional view of a swash plate type compressor having double headed pistons according to the second embodiment of the present invention.

In the second embodiment shown in FIG. 4, the control mechanism 49 includes regulating means in the form of annular projections 52 and 53 integrally projecting from the rotary valves 25 and 26 toward the swash plate 18 for engagement therewith. The annular projection 53 for the rear rotary valve 26 located on the upstream side in view of the prestressing direction (near the prestress mechanism 42) is longer than the other annular projection 52 for the front rotary valve 25 located on the downstream side (far from the prestress mechanism 42). Therefore, the allowable distance M2 of the movement of the rear rotary valve 26 is smaller than the allowable distance M1 of the movement of the front rotary valve 25.

Therefore, when the rotary valves 25 and 26 are caused to rearwardly move away from the valve chambers 21 and 22 against the springs 28 and 29 due to liquid compression or the like, the rear rotary valve 26 is rearwardly moved at a smaller distance than the front rotary valve 26. Accordingly, the liquid compressing state in the rear compression chambers 75 is prolonged more than the front compression chambers 74 to some extent, and it is possible to prevent the drive shaft 16 from undesirably oscillating, in a manner similar to the first embodiment. In the second embodiment too, the construction can be simple since it is only necessary to provide the annular projections 52 and 53 onto the rotary valves 25 and 26.

Figure 5:
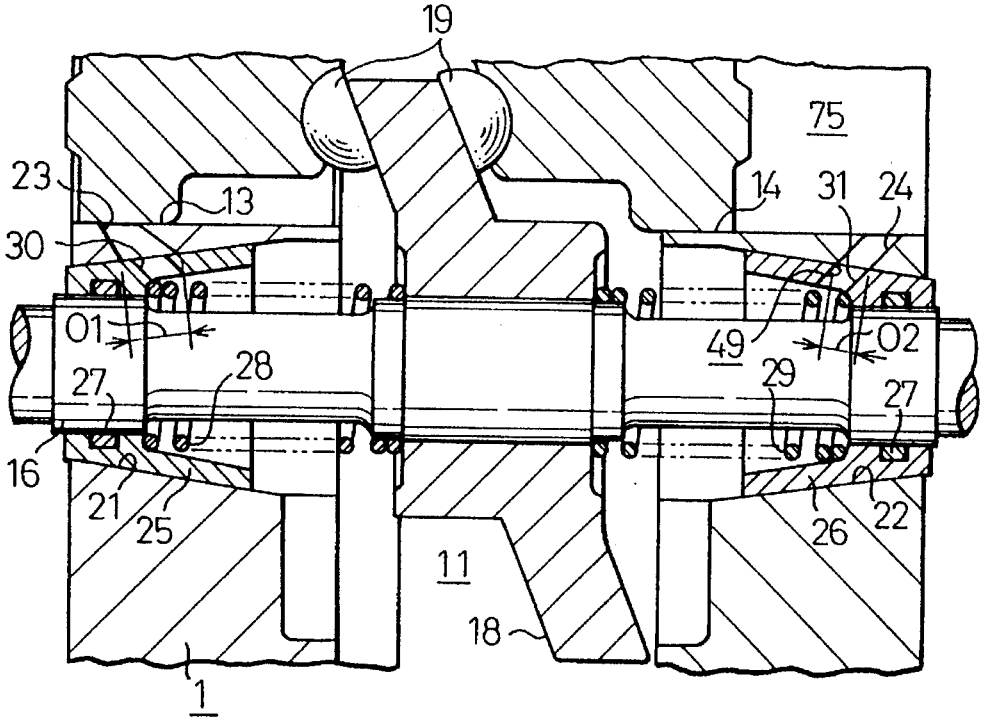
FIG. 5 is a cross-sectional view of a swash plate type compressor having double headed pistons according to the third embodiment of the present invention.

In the third embodiment shown in FIG. 5, the control mechanism 49 is formed such that the suction port 23 for the front rotary valve 25 located on the downstream side, from the point of view of the prestressing direction, is formed in a tapered shape so that an opening area of the suction port 23 gradually increases toward the front rotary valve 25. Therefore, the opening area O2 of the suction port 24 for the rear rotary valve 26 located on the upstream side in view of the prestressing direction is smaller than the opening area O1 of the suction port 23 for the front rotary valve 25 located on the downstream side.

Therefore, the force acting on the outer surface of the rear rotary valve 26 from the rear compression chambers 75 through the suction ports 24 is smaller than that acting on the outer surface of the front rotary valve 25 from the front compression chambers 74 through the suction ports 23. Therefore, when the rotary valves 25 and 26 are caused to rearwardly move away from the valve chambers 21 and 22 due to liquid compression or the like, the rear rotary valve 26 is rearwardly moved at a timing later than, and by a distance smaller than, those of the front rotary valve 26. Accordingly, the liquid compressing state in the rear compression chambers 75 is prolonged more than the front compression chambers 74 to some extent, and it is possible to prevent the drive shaft 16 from undesirably oscillating. In this third embodiment too, the Construction is simple since it is only necessary to change the opening areas of the suction ports 23 and 24.

In order to enlarge the opening area O1 of the suction port 23, it is not limited to form the suction port 23 in a tapered shape, but it is possible to uniformly enlarge the suction port 23 along the length. However, if the suction port 23 is formed in the tapered shape according to the third embodiment, the volume of the suction port 23 is not greatly increased and it does not affect the compression efficiency. It is also possible to form the suction port 23 so that the opening area of the suction port 23 increases stepwise toward the front rotary valve 25.

Figure 6:
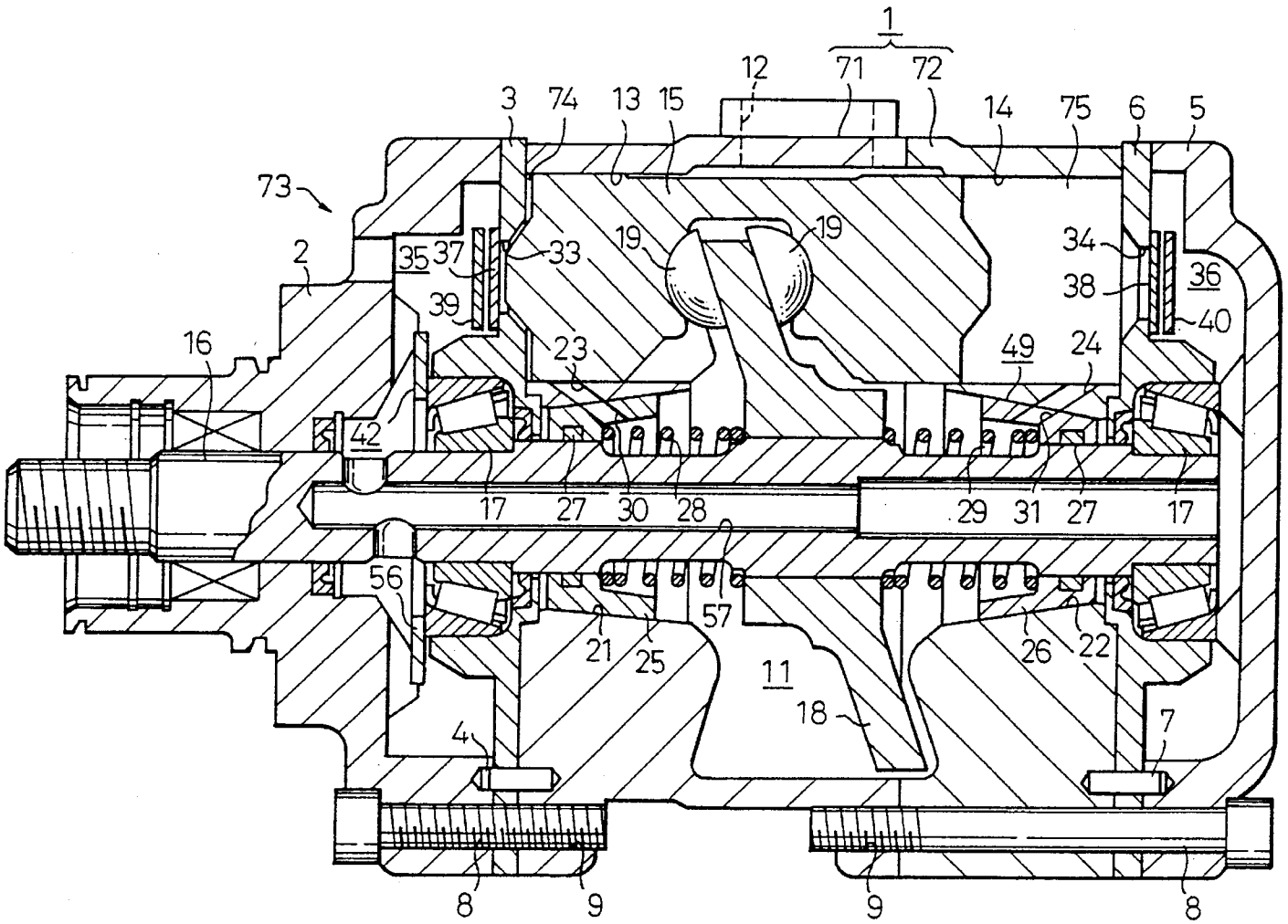
FIG. 6 is a cross-sectional view of a swash plate type compressor having double headed pistons according to the fourth embodiment of the present invention.
Figure 7:
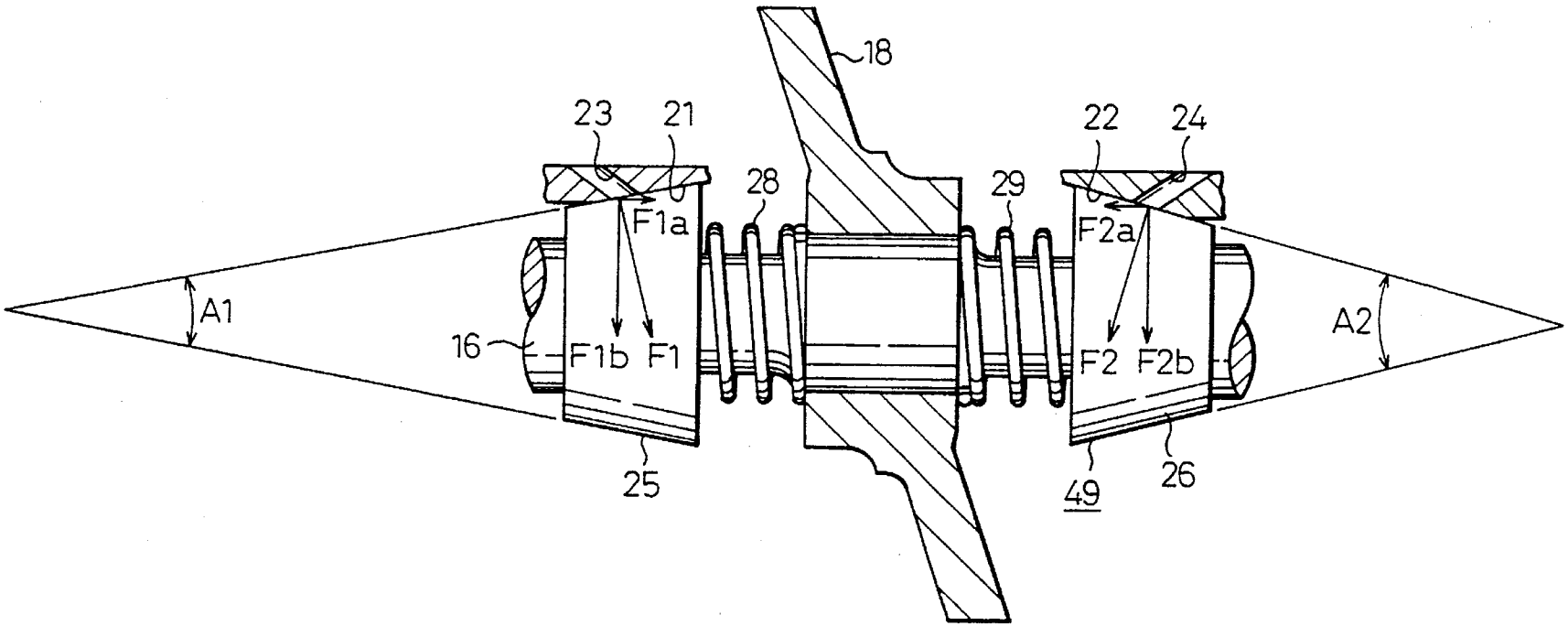
FIG. 7 is a partial cross-sectional view of the compressor of FIG. 7, illustrating the angle of the taper of the rotary valves and forces acting on the rotary valves.
Figure 8:
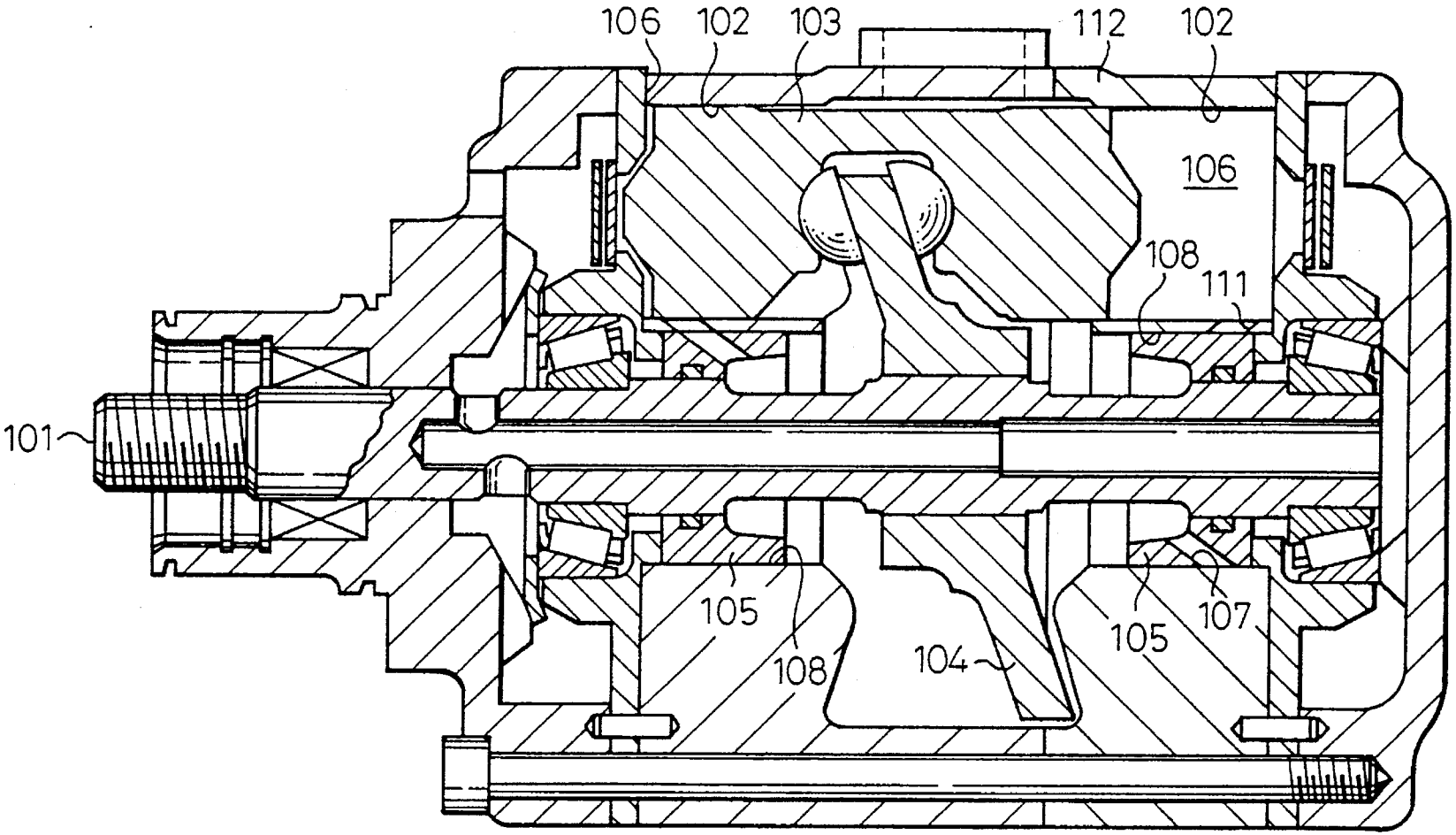
Fig.8 PRIOR ART
FIG. 8 is a cross-sectional view of a prior art compressor.
Figure 9:
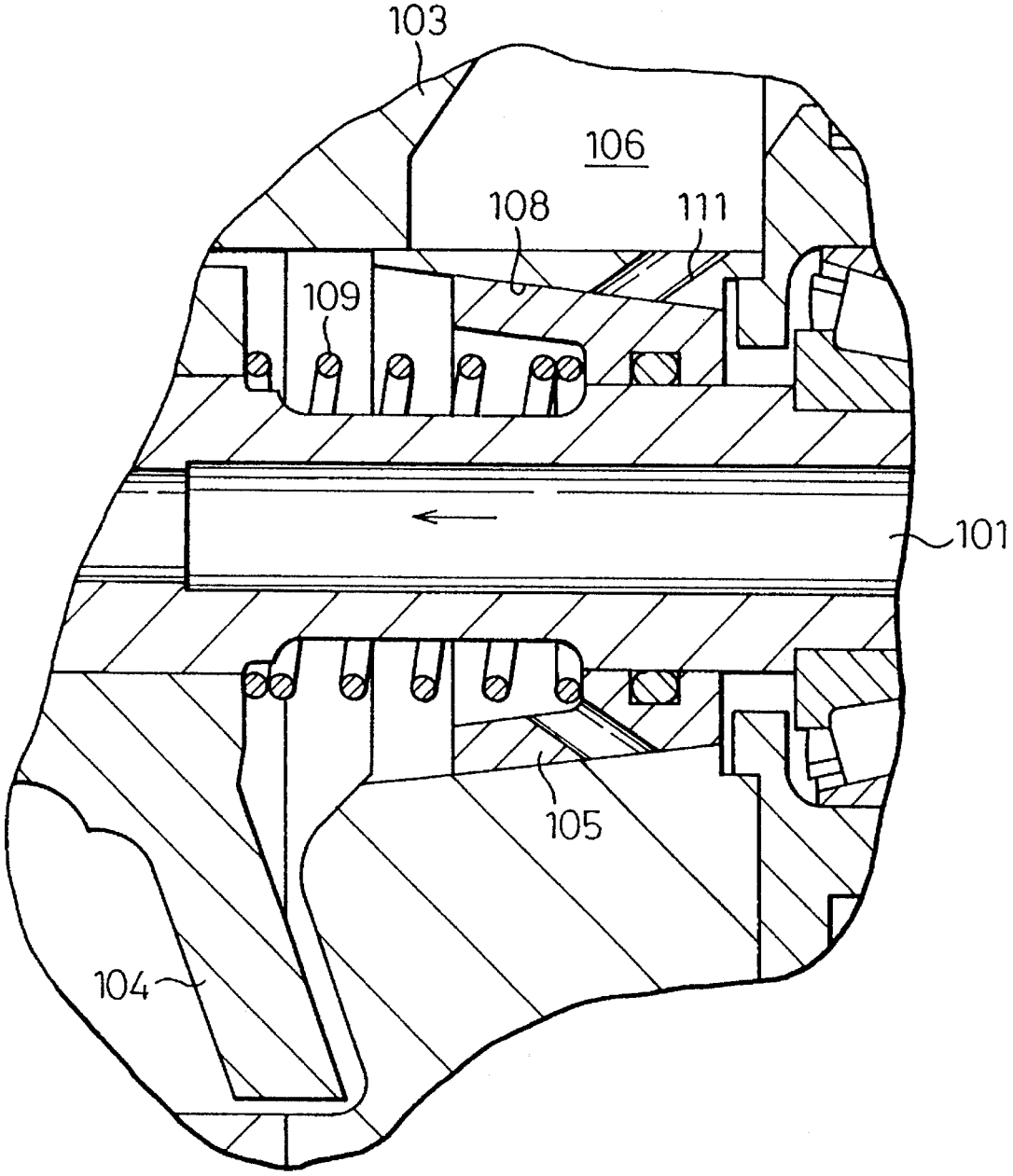
Fig.9 PRIOR ART
FIG. 9 is a cross-sectional view of another prior art compressor.

In the fourth embodiment shown in FIGS. 6 and 7, not only the control mechanism 49 but also the prestress mechanism 42 is changed from those of the first embodiment. Namely, in thus embodiment, the roller bearings 17 for rotatably supporting the drive shaft 16 are attached to the outer surface of the valve plates 3 and 6. A belleville spring 56 constituting the prestress mechanism 42 is arranged between the front bearing 17 and the front housing member 2 in the prestressed state, and the drive shaft 16 is urged by the belleville spring 56 in the rearward direction opposite to the urging direction of the first to third embodiments. A discharge passage 57 is formed through the drive shaft 16 along the axis thereof so as to interconnect the front and rear discharge chambers 35 and 36.

In this embodiment, the control mechanism 49 is formed such that the angle A1 of the taper of the front rotary valve 25 located on the upstream side from the point of view of the prestressing direction is smaller than the angle A2 of the taper of the rear rotary valve 26 located on the downstream side. Therefore, the pressures F1 and F2 acting on the outer surfaces of the rotary valves 25 and 26 can be separated into axial force components F1*a* and F2*a*, and transverse force components F1*b* and F2*b* perpendicular to the former, respectively, and the axial force component F1*a* for the front rotary valve 25 is smaller than the axial force component F2*a* for the rear rotary valve 26.

Therefore, when the rotary valves 25 and 26 are caused to rearwardly move away from the valve chambers 21 and 22 due to a liquid compression or the like, the front rotary valve 25 is rearwardly moved at a time later than, and by a distance smaller than, the time and distance of the rear rotary valve 26. Accordingly, it is possible to prevent the drive shaft 16 from undesirably oscillating. In this fourth embodiment too, the construction is simple since it is only necessary to change the angles of the taper of rotary valves 25 and 26.

It will be understood that the present invention is not limited to the above described embodiments, but various modifications and changes can be made without departing from the spirit of the present invention and the scope of the appended claims.

For example, in the first embodiment shown in FIG. 1, it is possible to omit the belleville spring 47. Therefore, the prestress is effected only by the discharge pressure.

In the second embodiment, it is possible to arrange the projections 52 and 54 as the regulating means on the front and rear surfaces of the swash plate 18. Also, in the second embodiment, it is possible to arrange the regulating means on the inner surfaces of the valve chambers 21 and 22. Also, in the second embodiment and the modifications described above, it is possible to form the projections 52 and 54 in a shape other than an annular shape, such as a strip-like shape or a rod-like shape.

It is possible to combine the features of the first to fourth embodiments. For example, it is possible to combine the feature of the first embodiment with at least one of the features of second to fourth embodiments. Also, it is possible to combine the feature of the second embodiment with at least one of the features of the third and fourth embodiments. Also, it is possible to combine the feature of the third embodiment with the feature of the fourth embodiment.

In the above described embodiments, it is possible to reverse the direction of the tapers of the valve chambers 21 and 22 and the rotary valves 25 and 26. That is, the outer diameter sides of the tapers are oriented to the outer ends of compressor. In this case, the springs 28 and 29 are arranged between the rotary valves 25 and 26 and the roller bearings 17. Also, it is possible to arrange passages connecting the chambers for the roller bearings 17 to the crank chamber 11 to introduce the coolant gas into the suction passages 30 and 31.

In addition, it is possible to apply the present invention to other reciprocating compressors such as the wave plate type compressor disclosed in Japanese Unexamined Patent Publication (Kokai) No. 57-110783.

As explained, according to the present invention, it is possible to reduce the oscillation and the noise of the compressor during the operation thereof, by arranging a reciprocating compressor having double headed pistons such that when the pressures in the cylinder bores rise abnormally due to liquid compression or the like, a compression reaction force acting on the drive shaft occurs in the prestressing direction of the drive shaft. This can be attained by simple arrangement, for example, by changing the urging force of the urging springs for urging the rotary valves, by arranging regulating means such as projections, by changing the opening area of the suction ports toward the rotary valves, or by changing the angles of the taper of the rotary valves.

We claim:

1. A reciprocating compressor comprising:

a housing having an axis, a front and a rear cylinder block having a plurality of pairs of cylinder bores arranged around the axis with each pair including coaxially extending front and rear cylinder bores, a crank chamber formed between said front and rear cylinder blocks, and a tapered valve chamber formed in the cylinder blocks on either side of the crank chamber along the axis, the tapered valve chambers having conical inner surfaces with larger and smaller diameter ends;

double headed pistons arranged in the respective pairs of cylinder bores to form compression chambers at either head of the pistons;

a drive shaft inserted in the crank chamber and the valve chambers and rotatably supported by the housing;

a cam plate arranged in the crank chamber and fixed to the drive shaft to engage with the pistons for reciprocatingly moving the pistons;

a pair of tapered rotary valves arranged in the valve chambers and supported by the drive shaft so that each rotary valve can rotate with the drive shaft and can move axially relative to the drive shaft, the rotary valves having conical outer surfaces to make surface-contact with the conical inner surfaces of the valve chambers;

the rotary valves having suction passages for introducing a coolant gas into the compression chambers during suction strokes;

first urging means for urging each of the rotary valves into contact with the conical inner surface of the associated valve chamber;

second urging means for urging the drive shaft in an axially predetermined direction; and means for controlling the movements of the rotary valves away from the valve chambers caused by a pressure in the compression chambers when the pressure in the compression chambers becomes higher than the compression pressure during normal operation of the compressor so that a compression reaction force acting on the drive shaft via the pistons and the cam plate occurs in said axially predetermined direction.

2. The compressor according to claim 1, wherein the crank chamber is formed to function as a suction chamber which is connected to a suction side of an outside refrigerating circuit, and the valve chambers are arranged so that the larger diameter ends of the valve chambers face the crank chamber.

3. The compressor according to claim 1, wherein said means for controlling the movements of the rotary valves is arranged such that the amount of the movement of one rotary valve is smaller than the amount of the movement of the other rotary valve.

4. The compressor according to claim 1, wherein said means for controlling the movements of the rotary valves is arranged such that the time of the movement of one rotary valve is later than the time of the movement of the other rotary valve.

5. The compressor according to claim 1, wherein said means for controlling the movements of the rotary valves is arranged such that an urging force from said first urging means for one rotary valve is greater than an urging force from said first urging means for the other rotary valve.

6. The compressor according to claim 1, wherein said means for controlling the movements of the rotary valves includes means for regulating the movements of the rotary valves such that the amount of the movement of one rotary valve is smaller than the amount of the movement of the other rotary valve.

7. The compressor according to claim 1, wherein the housing has suction ports, and said means for controlling the movements of the rotary valves is arranged such that the opening area of the suction port for one rotary valve is smaller than the opening area of the suction port for the other rotary valve.

8. The compressor according to claim 1, wherein said means for controlling the movements of the rotary valves is arranged such that the angle of the taper of one rotary valve is smaller than the angle of the taper of the other rotary valve.

* * * * *